US008998222B2

(12) United States Patent
Huang

(10) Patent No.: US 8,998,222 B2
(45) Date of Patent: Apr. 7, 2015

(54) FOLDABLE ROLLATOR

(76) Inventor: Wendy Huang, New Taipei (TW)

( * ) Notice: Subject to any disclaimer, the term of this patent is extended or adjusted under 35 U.S.C. 154(b) by 0 days.

(21) Appl. No.: 13/606,753

(22) Filed: Sep. 7, 2012

(65) Prior Publication Data

US 2013/0062864 A1 Mar. 14, 2013

(30) Foreign Application Priority Data

Sep. 9, 2011 (TW) ..... 100216985 U

(51) Int. Cl.

*B62B 7/06* (2006.01)
*A61H 3/04* (2006.01)
*A61H 3/00* (2006.01)

(52) U.S. Cl.

CPC ..... *A61H 3/04* (2013.01); *A61H 2003/002* (2013.01); *A61H 2003/003* (2013.01); *A61H 2201/0161* (2013.01); *A61H 2201/1633* (2013.01)

(58) Field of Classification Search

CPC ..... A61H 3/04; B62B 7/08; B62B 7/064; B62B 9/174; B62J 11/00
USPC ..... 280/47.34, 47.38, 47.4, 642, 643, 658
See application file for complete search history.

(56) References Cited

U.S. PATENT DOCUMENTS

| | | | | | |
|---|---|---|---|---|---|
| 808,905 | A * | 1/1906 | Curwen | ..... | 297/101 |
| 4,697,780 | A * | 10/1987 | Wenkman et al. | ..... | 248/558 |
| 5,290,049 | A * | 3/1994 | Crisp et al. | ..... | 280/30 |
| 5,468,009 | A * | 11/1995 | Eyman et al. | ..... | 280/650 |
| 5,961,015 | A * | 10/1999 | Shirakawa | ..... | 224/442 |
| 2006/0284040 | A1 * | 12/2006 | Nixon et al. | ..... | 248/311.2 |

* cited by examiner

*Primary Examiner* — Hau Phan
*Assistant Examiner* — Bryan Evans
(74) *Attorney, Agent, or Firm* — SmithAmundsen LLC; Kelly J. Smith; Dennis S. Schell

(57) ABSTRACT

A foldable rollator includes: a main support frame including two spaced-apart front support rods; a rear support frame including two spaced-apart rear support rods pivotally coupled to the front support rods, respectively; a plurality of wheels respectively installed on the main support frame and the rear support rods for rolling on the ground; an intermediate support frame coupled to the main support frame and the rear support frame, including a front support sub-frame pivotally coupled between the front support rods and a rear support sub-frame pivotally coupled between the rear support rods, the front and rear support sub-frames being further pivotally coupled to an axle; a seat unit disposed atop the intermediate support frame; and a backrest unit pivotally coupled to the axle.

11 Claims, 4 Drawing Sheets

FOLDABLE ROLLATOR

CROSS-REFERENCE TO RELATED APPLICATION

This application claims priority of Taiwanese Application No. 100216985, filed on Sep. 9, 2011.

BACKGROUND OF THE INVENTION

1. Field of the Invention

The invention relates to a wheeled ambulatory support, more particularly to a foldable rollator.

2. Description of the Related Art

A rollator is a type of walking aid for the elderly or patients suffering from conditions that hinder walking and functions by reducing the burden carried by the user's lower limbs. Generally, the rollator includes a pair of front support frames, two hand grips attached to the pair of the front support frames, respectively, a pair of rear support frames angularly and pivotally coupled to the front support frames, respectively, two transverse links with one attached between the two front support frames and the other attached between the two rear support frames, and four wheels, each of which is attached to a ground-attaching end of each of the front support frames and the rear support frames.

Frequently, a rollator also includes two folding mechanisms. Each folding mechanism is disposed underneath a corresponding pivotal connection and includes two pivotally connected shafts connected to the respective front support frame and the corresponding one of the rear support frames coupled thereto, respectively. When the rollator is unfolded, the two shafts of each folding mechanism forma line. When the rollator is folded, the shafts of each folding mechanism are pivoted toward one another, causing the front support frames and the rear support frames connected thereto to pivot together until the rollator is at the folded position.

However, because the primary users of rollators are the elderly and patients suffering from conditions that hinder mobility, this type of folding mechanism is burdensome because it requires the user to bend at the waist to effectively use the folding mechanism. In addition, this type of mechanism could cause injuries if fingers are caught in the folding mechanism.

SUMMARY OF THE INVENTION

Therefore, the object of the present invention is to provide a foldable rollator that allows the elderly and patients suffering from conditions that hinder mobility to easily fold the rollator.

Accordingly, a foldable rollator of the present invention comprises a main support frame, a rear support frame, a plurality of wheels, an intermediate support frame, a seat unit, and a backrest unit.

The main support frame includes two spaced-apart front support rods, each of the front support rods having a top end and a bottom end opposite to the top end and a hand grip attached to the top end and extending therefrom.

The rear support frame includes two spaced-apart rear support rods pivotally coupled to the front support rods. Each of the rear support rods has a top end and a bottom end opposite to the top end. The plurality of wheels are respectively installed on the main support frame and the bottom ends of the rear support rods for rolling on the ground.

An intermediate support frame is coupled to the main support frame and the rear support frame below the pivotal connection therebetween and includes a front support sub-frame pivotally coupled between the front support rods and a rear support sub-frame pivotally coupled between the rear support rods. The front support sub-frame and the rear support sub-frame are further pivotally coupled to a transverse axle. The seat unit is disposed atop the intermediate support frame. The backrest unit is pivotally coupled to the transverse axle.

In a use state of the rollator, the front support frame and the rear support frame are level, and in a non-use state of the rollator, the transverse axle is pulled upwards, causing the front support frame and the rear support frame to pivot towards each other, thus bringing the front support rods and the rear support rods together to move to the folded position.

The effect of this invention resides in use of the pivot connection between the intermediate support frame and the connected backrest unit to simplify the folding process to a single step involving pulling upwards on the backrest unit. Not only does this eliminate the need to bend at the waist, which can be an arduous task for the ill and elderly, and decrease the amount of effort required to fold the rollator, it also eliminates the risk of injuring one's fingers during the folding process.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
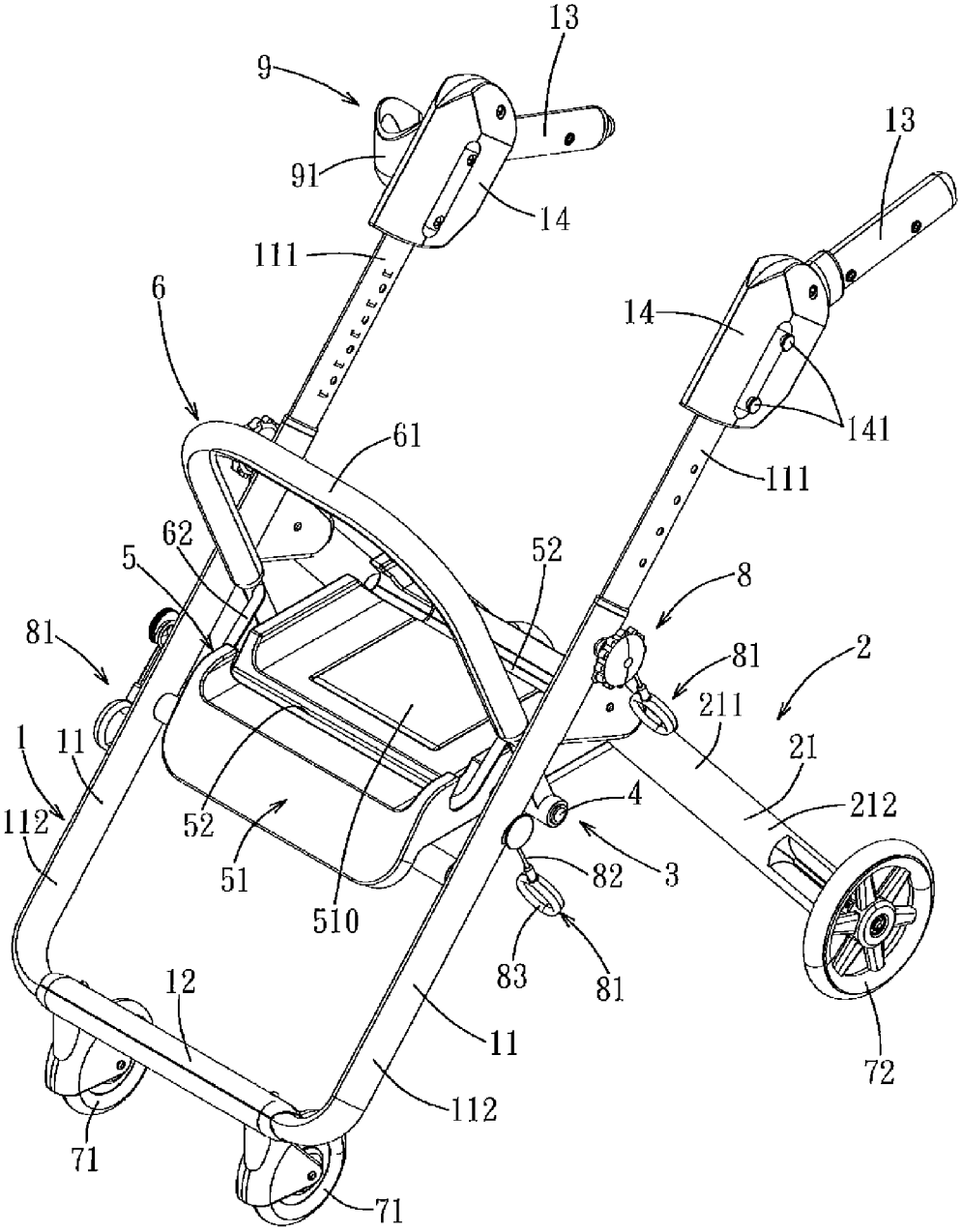
FIG. 1 is a perspective view of the preferred embodiment of a foldable rollator according to the present invention at an unfolded position.
Figure 2:
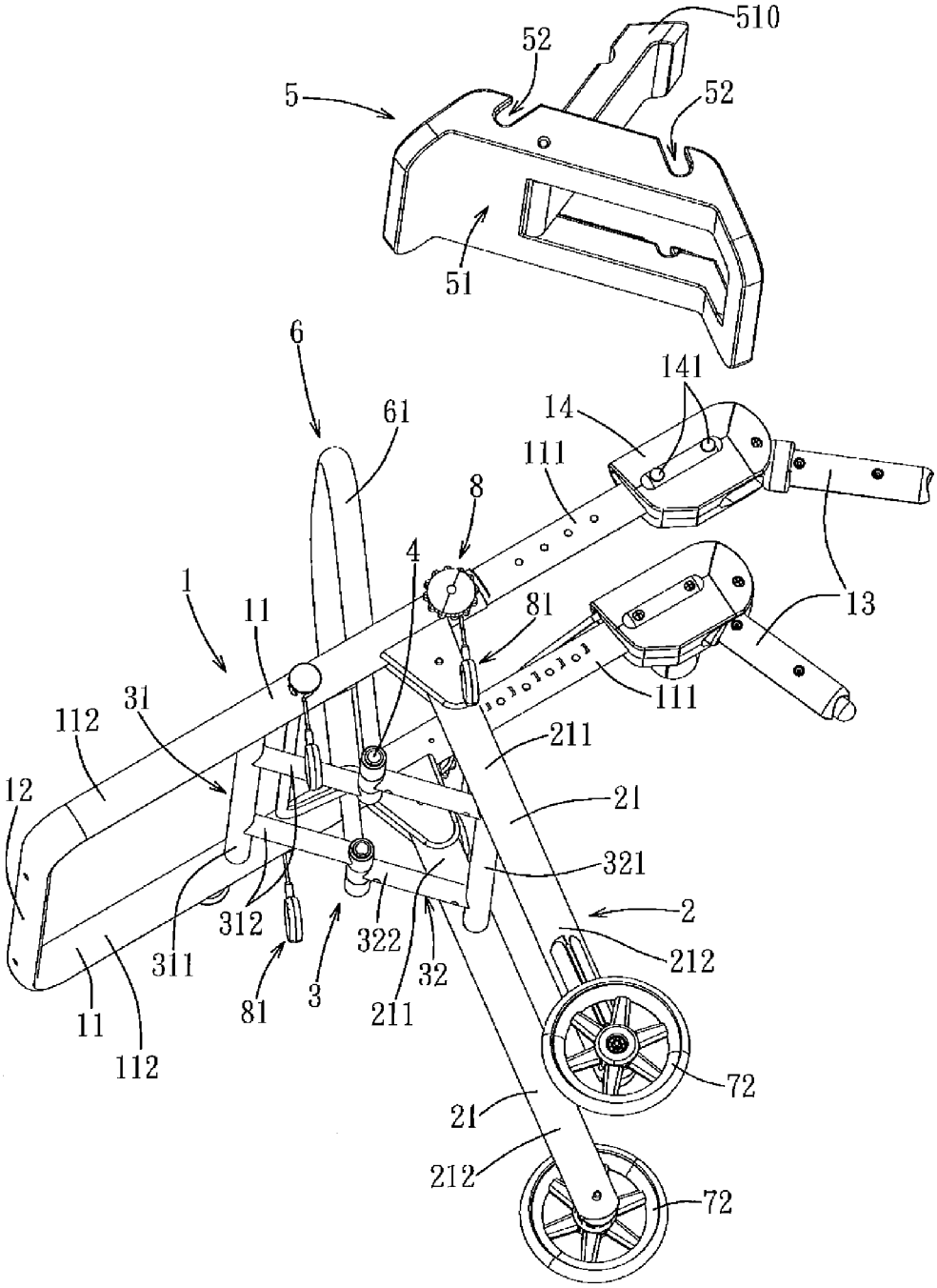
FIG. 2 is a partially exploded perspective view to illustrate the detailed structure of the preferred embodiment of FIG. 1.

With reference to FIGS. 1 and 2, the preferred embodiment of the foldable rollator of the present invention includes a main support frame 1, a rear support frame 2, an intermediate support frame 3, a seat unit 5, a backrest unit 6, two front wheels 71, and two rear wheels 72.

The main support frame 1 of the foldable rollator of this embodiment is a U-shaped body and includes: two spaced-apart front support rods 11, each front support rod 11 having a top end 111, a bottom end 112 opposite to the top end 111, and a hand grip 13 attached to the top end 111 and extending therefrom; a connector beam 12 connecting the bottom ends 112 of the front support rods 11; and a pair of cover bodies 14, each of which encapsulates the connection between each front support rod 11 and the corresponding hand grip 13 attached thereto. The rear support frame 2 includes a pair of rear support rods 21. Each of the rear support rods 21 includes a top end 211 and a bottom end 212 opposite to the top end 211. The top ends 211 of the rear support rods 21 are pivotally coupled to the front support rods 11 near their middle, respectively. The front wheels 71 are spaced-apart attached to the connector beam 12 of the main support frame 1 and the rear wheels 72 are attached to the bottom ends 212 of the rear support rods 21, respectively.

The intermediate support frame 3 is mounted under the pivotal connections between the front support rods 11 and the rear support rods 21. The intermediate support frame 3 includes a front support sub-frame 31 and a rear support sub-frame 32. The front support sub-frame 31 includes a front transverse link 311 pivotally coupled between the two front support rods 11 below the pivotal connection between the main support frame 1 and the rear support frame 2, and also a pair of spaced-apart front pivot spokes 312 extending from the front transverse link 311 to define free end portions, respectively. The rear support sub-frame 32 includes a rear transverse link 321 pivotally coupled between the two rear support rods 21 below the pivotal connection between the main support frame 1 and the rear support frame 2, and also a pair of spaced-apart rear pivot spokes 322 extending from the rear transverse link 321 to have free end portions, respectively. The free end portions of each front pivot spoke 312 and the corresponding one of the rear pivot spokes 322 are pivotally coupled to a transverse axle 4.

The seat unit 5 is a rigid structure disposed atop the intermediate support frame 3 and includes a seat body 51 having two positioning notches 52 dented from a top surface of the seat body 51. In this embodiment, the seat body 51 is fixed to the rear pivot spokes 322 of the rear support sub-frame 32 using screws so that only the rear portion of the seat body 51 is fixed. Alternatively, the seat body 51 may be fixed to the front pivot spokes 312 of the front support sub-frame 31 so that only the front portion of the seat body 51 is fixed. The seat body 51 of this embodiment also includes a hatch 510 such that the user could lift the hatch 510 to gain access to a basket (not shown) placed underneath the intermediate support frame 3. The positioning notches 52 form 45° angles with the normal line of the top e surface of the seat body 51 and extend along the transverse axle 4 through the sides of the seat body 51.

The backrest unit 6 includes a deep-U-shaped backrest frame 61 and a shallow-U-shaped positioning brace 62. The backrest frame 61 has two arms pivotally coupled to the transverse axle 4 and a free opening end defined by the two arms, sharing the transverse axle 4 with the front support sub-frame 31 and the rear support sub-frame 32. The positioning brace 62 has two arms pivotally coupled to the backrest frame 61 and defining a free opening end. The free opening ends of the backrest frame 61 and the positioning brace 62 face each at the unfolded position.

In an unfolded state of the preferred embodiment, the front support sub-frame 31 and the rear support sub-frame 32 of the intermediate support frame 3 are level and mutually limit their positions. There is no fixed mechanism for limiting their positions. The seat unit 5 is levelly situated atop the intermediate support frame 3 and the positioning brace 62 engages the positioning notch 52 such that the backrest frame 61 is slanted upwards towards the hand grips 13. In addition, when the user of the rollator becomes fatigued, he/she may sit on the seat unit 5 and lean against the backrest frame 61 to recuperate.

Figure 3:
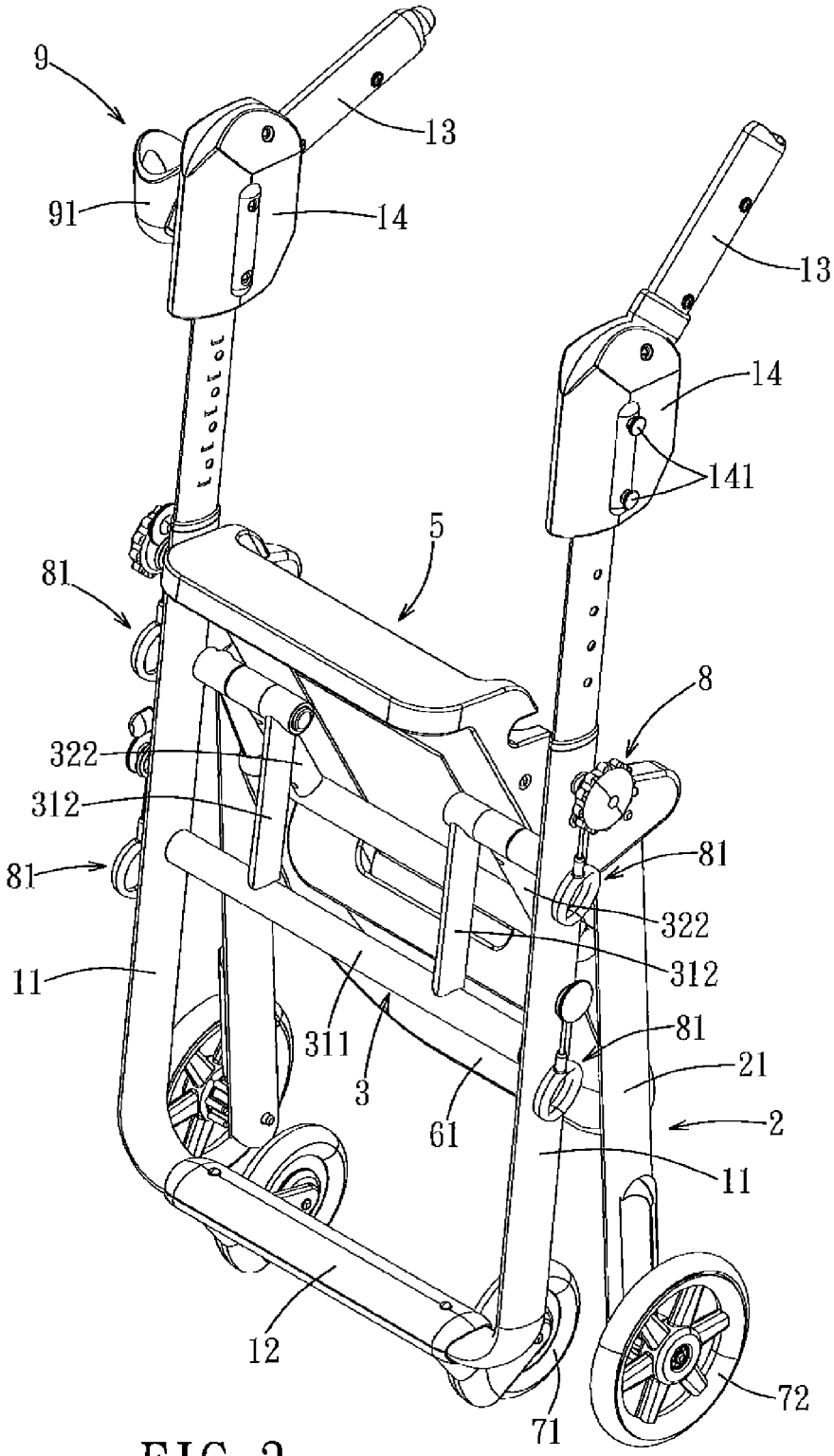
FIG. 3 is a perspective view to illustrate the preferred embodiment of FIG. 1 at a folded position.

With reference to FIGS. 1 and 3, in the embodiment, the rollator may be folded merely by holding onto the backrest frame 61 and pulling upwards such that the positioning brace 62 disengages the positioning notch 52. As the backrest frame 61 is pulled upwards, because the backrest frame 61 is pivotally connected to the transverse axle 4, the transverse axle 4 will be pulled upwards by the backrest frame 61. Similarly, because the front support sub-frame 31 and the rear support sub-frame 32 are pivotally connected to the transverse axle 4, they too will follow the transverse axle 4 upwards and thus form an angle therebetween. As the transverse axle 4 moves upwards, the angle between the front support sub-frame 31 and the rear support sub-frame 32 will diminish, thereby bringing the front support rods 11 and the rear support rods 21 together. Additionally, because only the rear end of the seat 51 is secured to the intermediate support frame 3, the unsecured front portion of the seat 51 will separate from the front support sub-frame 31 and the seat 51 will tilt to remain parallel with the rear support sub-frame 32. At this time, releasing the backrest frame 61 allows the backrest frame 61 and the positioning brace 62 to hang downwards. Further pushing the front support rods 11 and the rear support rods 21 together results in the folded state.

With reference to the folded rollator in FIG. 3, unfolding the rollator involves a mere reversal of the steps above. Lifting the backrest frame 61 allows the front wheels 71 and the rear wheels 72 to roll apart and leveling the seat unit 5 such that the positioning brace 62 engages the positioning notch 52 will bring the rollator into the unfolded state as shown in FIG. 1.

Figure 4:
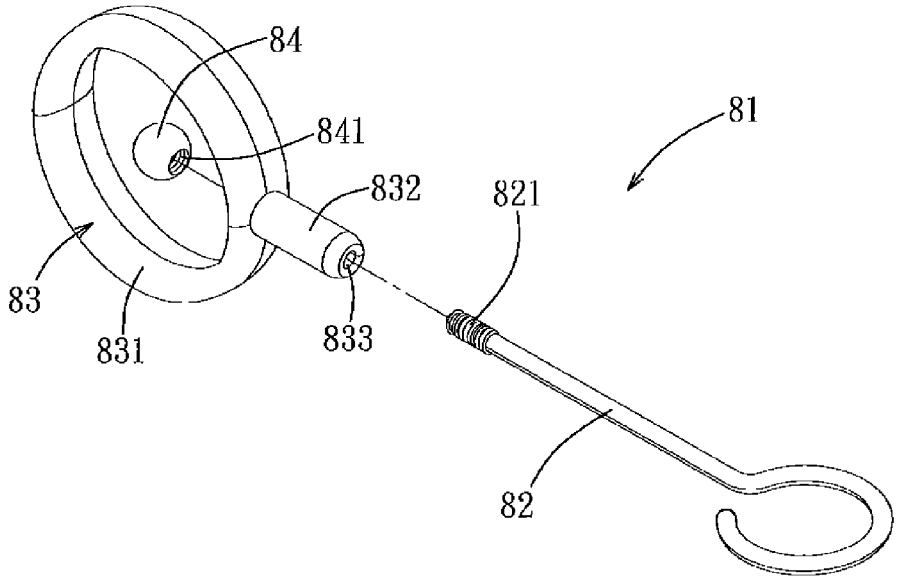
FIG. 4 is an exploded perspective view to illustrate a hanging ring unit of the preferred embodiment of FIG. 1.
Figure 5:
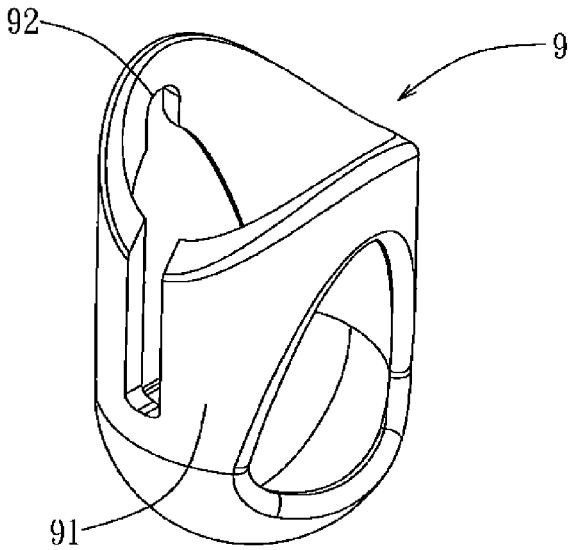
FIG. 5 is a perspective view to illustrate a cup holder unit of the preferred embodiment of FIG. 1.

Referring to FIGS. 1, 4 and 5, the rollator further comprises two umbrella support devices 8 respectively disposed at two opposite outer sides of the main support frame 11. Each umbrella support device 8 includes two spaced-apart hanging ring units 81.

Each of the hanging ring units 81 has a connecting rod 82 connected to the corresponding one of the front support rods 11 of the main support frame 1, a hanging ring 83 connected for 360 degree rotation to the connecting rod 82, and a limiting body 84. In this embodiment, the connecting rod 82 is a steel wire. The hanging ring 83 includes a ring body 831, a tubular body 832 extending radially from an outer surface of the ring body 831, and a passage hole 833 extending through the ring body 831 and the tubular body 832. The connecting rod 82 has one end configured as a hook to hang fixedly to the respective front support rod 11 of the main support frame 1, and the other end extending through the passage hole 833 and formed with an external thread 821. The limiting body 84 in this embodiment is configured as a ball having an outer diameter larger than an inner diameter of the passage hole 833, and has an internal thread 841 engaged to the external thread 821 of the connecting rod 41 to prevent the connecting rod 82 from escaping from the hanging ring 83. In this embodiment, the ring body 831 and the tubular body 832 of the hanging ring 83 are slightly resilient, and the passage hole 833 has a hole diameter slightly smaller than an outer diameter of the connecting rod 82. As such, the connecting rod 82 extends through the passage hole 833 in a tight-fitting manner. Even though the hanging ring 83 can be rotated 360 degrees about the connecting rod 82, the connecting rod 82 cannot easily slide relative to the hanging ring 83.

When the user needs to place an umbrella or a stick, the two connecting rods 82 are disposed at the same angle relative to the front support rod 11, respectively and the two hanging rings 83 are rotated to corresponding angle, the umbrella or the stick can then be extended into the two hanging rings 83. In this embodiment, the ball-shaped limiting body 84 can prevent sharp portion of the connecting rods 82 from scratching the user's hand or the surface of the umbrella or the stick. When there is no need to place the umbrella or the stick on the rollator, the connecting rods 82 and the hanging rings 63 can be rotated such that the entire hanging ring units 81 abut against the main support frame 1.

If a smaller rod-shaped object, such as an umbrella, a stick, etc., is to be placed on the rollator, each hanging ring 83 can be rotated close to the connecting rod 82 so as to move the limiting body 84 from one end of the ring body 831 that is proximate to the tubular body 832 to the other end of the ring body 831 that is distal from the tubular body 832, thereby dividing a space defined by the ring body 831 into two. At this time, a smaller umbrella or stick may be inserted into one of the spaces in the ring body 831 without falling off.

Referring to FIGS. 1 and 5, furthermore, in order to facilitate the user to place stably a beverage bottle or can on the rollator during pushing, each cover body 14 includes at least one positioning stud 141 projecting from an outer surface thereof. The rollator further comprises a cup holder 9 that is hung movably to the positioning stud 141. The cup holder 9 includes a cup holder body 91 defining a bottle accommodation space, and a hanging portion 92 formed on the cup holder body 91. In this embodiment, the hanging portion 92 is configured as a through hole that extends through one side of the cup holder body 91 and that has a size conforming with that of the positioning stud 141. As such, the cup holder 9 of a single specification can be placed on a left side or a right side of the main support frame 1 according to the user's requirement.

To sum up, this invention uses the pivot connection between the intermediate support frame 3 and the connected backrest unit 6 to simplify the folding process to a single step involving pulling upwards on the backrest unit 6. Not only does this eliminate the need to bend at the waist, which can be an arduous task for the ill and elderly, and decrease the amount of effort required to fold the rollator, it also eliminates the risk of injuring one's fingers during the folding process.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable rollator, comprising:

a main support frame including two spaced-apart front support rods, each of said front support rods having a top end, a bottom end opposite to the top end, and a hand grip attached to the top end and extending therefrom;

a rear support frame including two spaced-apart rear support rods, each of said rear support rods having a top end pivotally coupled to said front support rods and a bottom end opposite to the top end;

a plurality of wheels respectively installed under said main support frame and said rear support frame for rolling on the ground;

an intermediate support frame coupled to said main support frame and said rear support frame below the pivotal connection therebetween, including a front support sub-frame pivotally coupled between said front support rods and a rear support sub-frame pivotally coupled between said rear support rods, said front support sub-frame and said rear support sub-frame being further pivotally coupled to a transverse axle;

a seat unit disposed atop said intermediate support frame; and a backrest unit pivotally coupled to said transverse axle;

wherein said transverse axle is at substantially the same height as the pivotal connections of said front support sub-frame and said rear support sub-frame in an unfolded position, and wherein when said transverse axle is pulled upwards, said front support sub-frame and said rear support sub-frame pivot towards each other, thus bringing said front support rods and said rear support rods together to move to a folded position; and wherein said front support sub-frame includes a front transverse link pivotally coupled between said front support rods and a pair of spaced-apart front pivot spokes extending from said front transverse link to have free end portions, respectively; said rear support sub-frame includes a rear transverse link pivotally coupled between said rear support rods and a pair of spaced-apart rear pivot spokes extending from said rear transverse link to have free end portions, respectively; and said free end portions of each of said front pivot spokes and the corresponding one of said rear pivot spokes are pivotally coupled to said transverse axle.

2. The foldable rollator of claim 1, wherein:

said seat unit includes a seat body having at least one positioning notch;

said backrest unit includes a backrest frame having two arms pivotally coupled to said transverse axle and a positioning brace having two arms pivotally coupled to said backrest frame; and said positioning brace engages said positioning notch of said seat body to secure the position of said backrest frame at the unfolded position.

3. The foldable rollator of claim 2, wherein:

said backrest frame is a deep-U-shaped structure having an opening end; and said positioning brace is a shallow-U-shaped structure having an opening end facing said opening end of said backrest frame at the unfolded position.

4. The foldable rollator of claim 1, wherein said seat unit includes a seat body having a hatch liftable upwards away from said seat body.

5. The foldable rollator of claim 1, wherein said main support frame is U-shaped and further includes a connector beam connecting between said bottom ends of said front support rods such that said main support frame forms a U-shape and at least one of the wheels being attached to said connector beam.

6. The foldable rollator of claim 1, wherein said seat unit is fixed to one of said front support sub-frame and said rear support sub-frame.

7. The foldable rollator of claim 1, further comprising at least one umbrella support device that is mounted at an outer side of said main support frame, and that includes a pair of spaced hanging ring units, each of which has a connecting rod fixed to said main support frame and a hanging ring pivotable about said connecting rod for 360 degrees.

8. The foldable rollator of claim 7, wherein each of said hanging ring units includes a ring body, a tubular body extending radially from an outer surface of said ring body, and a passage hole extending through said ring body and said tubular body, said connecting rod having one hook end for hanging on said main support frame, and the other end extending through said passage hole and formed with an outer thread, said hanging ring unit further including a limiting body having an outer diameter larger than an inner diameter of said passage hole, said limiting body having an inner thread cooperating with said outer thread of said connecting rod, said limiting body being fastened to an end portion of said connecting rod for preventing said connecting rod from escaping from said hanging ring.

9. The foldable rollator of claim 8, wherein said passage hole has a hole diameter slightly smaller than an outer diameter of said connecting rod.

10. The foldable rollator of claim 1, wherein said main support frame further includes a pair of cover bodies, each of which encapsulates the connection between each front support rod and the hand grip attached thereto, and at least one positioning stud projecting from a surface of an outer side of one of the cover bodies; and wherein said foldable rollator further comprises a cup holder to be mounted hangingly and removably on said positioning stud, said cup holder including a bracket body defining an accommodation space adapted for accommodating a container, and a hanging portion formed on said bracket body for hanging on said positioning stud.

11. The foldable rollator of claim 10, wherein said hanging portion is a through opening extending through a side of said bracket body and having a size conforming with said positioning stud.

* * * * *